US009200865B2

(12) United States Patent
Maeda

(10) Patent No.: US 9,200,865 B2
(45) Date of Patent: Dec. 1, 2015

(54) TOY GUN AND TOY GUN GAS CARTRIDGE LOADING DEVICE

(71) Applicant: Maruzen Company Limited, Tokyo (JP)

(72) Inventor: Tetsuo Maeda, Tokyo (JP)

(73) Assignee: MARUZEN COMPANY LIMITED, Tokyo (JP)

( * ) Notice: Subject to any disclaimer, the term of this patent is extended or adjusted under 35 U.S.C. 154(b) by 0 days.

(21) Appl. No.: 14/157,111

(22) Filed: Jan. 16, 2014

(65) Prior Publication Data

US 2014/0338650 A1 Nov. 20, 2014

(30) Foreign Application Priority Data

May 15, 2013 (JP) ..... 2013-103401

(51) Int. Cl.
*F41B 11/56* (2013.01)
*F41B 11/62* (2013.01)

(52) U.S. Cl.
CPC ..... *F41B 11/62* (2013.01); *F41B 11/56* (2013.01)

(58) Field of Classification Search
CPC ..... F41B 11/00; F41B 11/50; F41B 11/51; F41B 11/56; F41B 11/60; F41B 11/62; F41B 11/70; F41B 11/89
See application file for complete search history.

(56) References Cited

U.S. PATENT DOCUMENTS

| | | | | |
|---|---|---|---|---|
| 6,470,872 | B1 | 10/2002 | Tiberius et al. | |
| 6,810,870 | B1 * | 11/2004 | Hu | 124/76 |
| 7,273,047 | B2 * | 9/2007 | Hu | 124/74 |
| 2004/0200466 | A1 * | 10/2004 | Salva | 124/74 |
| 2006/0112944 | A1 | 6/2006 | Su | |
| 2006/0201491 | A1 * | 9/2006 | Wei | 124/74 |
| 2008/0168973 | A1 * | 7/2008 | Levin et al. | 124/73 |
| 2014/0338650 | A1 * | 11/2014 | Maeda | 124/74 |
| 2015/0007804 | A1 * | 1/2015 | Tippmann et al. | 124/73 |

FOREIGN PATENT DOCUMENTS

| | | | |
|---|---|---|---|
| CH | 704013 | A2 | 4/2012 |
| JP | 2012-042116 | A | 3/2012 |

OTHER PUBLICATIONS

The Extended European Search Report in Application No. 13004520.6, mailed Nov. 19, 2013.
Extended European Search Report issued in EP Application No. 13005641.9, dated May 16, 2014.

* cited by examiner

*Primary Examiner* — Bret Hayes
*Assistant Examiner* — Derrick Morgan
(74) *Attorney, Agent, or Firm* — Michael Best & Friedrich LLP

(57) ABSTRACT

A toy gun includes a toy gun body and a toy gun gas cartridge loading device to be attached to the toy gun body. The toy gun body has a loading device housing located around a gun body coupling valve. When attaching the toy gun gas cartridge loading device to the toy gun body with an end portion of the device inserted in the loading device housing of the toy gun body, a lock of the loading device is locked with a first lock of the gun body, and when detaching it from the toy gun body, the lock of the loading device is locked with a gun body second lock.

3 Claims, 15 Drawing Sheets

TOY GUN AND TOY GUN GAS CARTRIDGE LOADING DEVICE

CROSS-REFERENCE TO RELATED APPLICATION(S)

This application is based upon and claims the benefit of priority from Japanese Patent Application JP2013-103401, filed on May 15, 2013, the entire disclosure of which is incorporated herein by reference.

BACKGROUND OF THE INVENTION

The present invention relates to a toy gun and a loading device for a toy gun. More particularly the invention relates to a toy gun to which a gas cartridge can be attached to fire a bullet by the pressure of compressed gas in the gas cartridge, and a toy gun gas cartridge loading device for loading a gas cartridge in the toy gun.

In some of the air guns which fire a bullet using compressed gas such as $CO_2$ gas, an attachable/detachable toy gun gas cartridge loading device (puncture unit) is attached to the gun body with a gas cylinder housed in the loading device.

This type of air gun is more advantageous than a toy gun with a gas cylinder housed directly in the gun body in the sense that it is easier to cope with change in the gas which may be caused by firing. The reason is as follows. Generally, in an air gun which uses compressed gas as an energy source, the gas becomes cool after firing. When the gas becomes cool, the expansion force of the gas weakens and the following problem arises: the bullet speed drops or in the case of a blowback toy gas gun, the gun fails to work normally, for example, a blowback failure occurs.

In a toy gun in which a gas cylinder is housed directly in the gun body, when the gas has been once used and becomes cool, it is difficult to warm the gas and sometimes it may be necessary to warm it, for example, by putting the gun in a warm place.

A toy gun which uses an attachable/detachable toy gun gas cartridge loading device is more convenient because the user can restart using the toy gun immediately after replacement of the toy gun gas cartridge loading device.

In the case of a toy gun in which two gas cylinders are housed directly in the toy gun body, it is troublesome for the user since the gas cylinders must be replaced one by one.

On the other hand, a toy gun which uses a toy gun gas cartridge loading device is more convenient in the sense that even when the air gun uses two gas cylinders, the user has only to replace a single puncture unit upon replacement of the gas cylinders.

There are two types of toy air gun which use a toy gun gas cartridge loading device: in one type, the gas cartridge loading device has a valve to fire a bullet and in the other type, the gas cartridge loading device does not have such a valve.

In the latter type of air gun, when the toy gun gas cartridge loading device is attached to the toy gun body, the gas in the gas cylinder of the gas cartridge loading device flows into the air chamber of the toy gun body. As the user pulls the trigger to fire a bullet, a discharge valve opens and the gas quickly flows out of the air chamber to fire the bullet. The present invention concerns an air gun which uses a toy gun gas cartridge loading device as mentioned above and has a valve built in the toy gun body.

An example of a toy gun gas cartridge loading device of this type in the related art is disclosed in JP-A-2012-42116 entitled TOY GUN AND LOADING DEVICE. The device is described as follows: "An air chamber body 122 located in a toy gun forms an air chamber 126. The compressed gas in the air chamber body 122 passes through a gas discharge part to fire a bullet held in a bullet holder from a muzzle. A valve opens and closes the communication between the air chamber body 122 and the gas discharge part according to operation of an operating part. The toy gun includes a plurality of gas cartridge holders 210. Gas cylinders 102 are loaded in the gas cartridge holders 210. Each gas cartridge holder 210 has a first valve. The compressed gas in the gas cylinder 102 loaded in the gas cartridge holder 210 is passed through a gas introduction part 301 and introduced into the air chamber 126."

However, when the toy gun gas cartridge loading device is detached from the gun for replacement, etc., if there is residual compressed gas in the air chamber of the toy gun body, the gas is going to flow out quickly, so the toy gun gas cartridge loading device may jump out of the toy gun body. Therefore, in order to prevent the toy gun gas cartridge loading device from jumping out in this way, a toy gun in the related art has a double-step mechanism to detach the toy gun gas cartridge loading device from the toy gun body as mentioned below.

The double-step mechanism in the related art is as shown in FIGS. 15 and 16. FIG. 15 is a fragmentary enlarged view of a toy gun gas cartridge loading device attached to a toy gun in the related art and its vicinity and FIG. 16 is a fragmentary enlarged view of the toy gun gas cartridge loading device in the related art and its vicinity, in which the toy gun gas cartridge loading device is being detached from the toy gun with a second puncture catch engaged with the toy gun gas cartridge loading device.

In this related art, a reference numeral 201 denotes a toy gun body and a reference numeral 202 denotes a valve. As shown in the figures, the valve 202 is fixed in the toy gun body 201. A reference numeral 204 denotes an air chamber and 205 denotes a gun body side coupling valve. A reference numeral 211 denotes a toy gun gas cartridge loading device (puncture unit) which houses two gas cylinders 212.

A member which disengages the valve 202 and the toy gun gas cartridge loading device 211 from each other is referred to as a first lock (puncture catch) 213 and a member which once locks the toy gun gas cartridge loading device 211 is referred to as a second lock (second puncture catch) 214.

A fixing groove 215 is provided on a lateral surface of the toy gun gas cartridge loading device 211. As the toy gun gas cartridge loading device 211 begins disengaging from the toy gun body 201, a puncture catch lock 216 fixed on the tip of the second lock 214 of the toy gun body 201 fits in the fixing groove 215, so that the toy gun gas cartridge loading device 211 is once locked and fixed (FIG. 16).

By pushing down the first lock 213 located in the loading device housing 203 of the toy gun body 201, the first lock 213 is turned and the toy gun gas cartridge loading device 211 is disengaged from the first lock (puncture catch) 213.

At this moment, the toy gun gas cartridge loading device (puncture unit) 211 tries to be released from the toy gun body 201 by the pressure of the gas in the air chamber of the toy gun body 201 but the puncture catch lock 216 at the tip of the second lock 214 fits in the fixing groove 215 of the toy gun gas cartridge loading device 211.

The gas in the air chamber is passed through the space between the toy gun gas cartridge loading device 211 and the air chamber 204 and forced out of the toy gun body 201.

Then, by pushing down the second lock 214, the second lock 214 and the toy gun gas cartridge loading device 211 are disengaged from each other and as shown in FIG. 16, the toy gun gas cartridge loading device 211 becomes safely detachable.

In other words, the double-step mechanism to detach the toy gun gas cartridge loading device 211 from the toy gun body 201 includes the following steps as shown in FIGS. 15 and 16.

(1) Immediately after the valve 202 in the toy gun body 201 and the first lock 213 of the toy gun gas cartridge loading device 211 are disengaged from each other, the toy gun gas cartridge loading device 211 is once locked by the second lock 214 as another lock member provided on the toy gun body 201.

As a consequence, the gas in the air chamber of the toy gun body 201 flows out of the toy gun body 201, thereby eliminating the possibility that the toy gun gas cartridge loading device 211 might jump out.

(2) The user unlocks the toy gun gas cartridge loading device 211 from the second lock 214 and takes the toy gun gas cartridge loading device 211 out of the toy gun body 201.

The "toy gun and toy gun gas cartridge loading device" which is disclosed in Japanese Patent Application No. 2013-077284 as filed by the present applicant also includes a double-step mechanism which uses a first lock and a second lock and requires the user to carry out step (2) above.

Patent Document 1

Japanese Unexamined Patent Publication No. 2012-42116

However, the above related art technique has the following problem: in order to detach the gas cartridge loading device from the toy gun body, the user must carry out the following two actions:

(1) pushing the first lock, then (2) pushing the second lock.

SUMMARY OF INVENTION

An object of the present invention is to enable the first lock and the second lock to interlock with each other so that the gas cartridge loading device can be detached from the toy gun body step by step only by pushing the first lock with a finger and releasing it sequentially.

This means that in an air gun which uses high pressure gas, a gas cartridge can be replaced safely and more easily than before.

In addition, since the first lock is not exposed so much, there is no significant influence on similarity to a real gun design, which is important for a toy air gun which is manufactured in imitation of a real gun and the commercial value of the toy air gun is not impaired. This provides a useful means to solving the problem.

A toy gun of the present invention comprises a toy gun body and a toy gun gas cartridge loading device to be attached to the toy gun body, the toy gun body comprising:

a gun body coupling valve for introducing compressed gas from outside and supplying the compressed gas into the toy gun body;

a loading device housing located around the gun body coupling valve;

a bar-like member which is attached midway to a lateral surface of the loading device housing by a bar-like member rotating shaft for allowing an upper end and a lower end thereof to freely rotate inward of the loading device housing or outward of the loading device housing, with the upper end biased inward of the loading device housing;

a gun body first lock which is located in an upper portion of the loading device housing and provided on the upper end of the bar-like member and locked with a loading device lock provided on the toy gun gas cartridge loading device when inserting a toy gun body side end portion of the toy gun gas cartridge loading device through an opening of the loading device housing for attachment to the toy gun body; and a gun body second lock which is located nearer to the lower end of the bar-like member than the bar-like member rotating shaft and lower than the gun body first lock and locked with the loading device lock provided on the toy gun gas cartridge loading device when detaching the toy gun gas cartridge loading device from the toy gun body, wherein the toy gun gas cartridge loading device houses a gas cartridge; and wherein, for attachment to the toy gun body, a toy gun side end portion of the toy gun gas cartridge loading device is housed in the loading device housing of the toy gun body;

the toy gun gas cartridge loading device comprising:

a loading device coupling valve which is located at a tip of the toy gun gas cartridge loading device and coupled to a gun body coupling valve of the toy gun body for attachment to the toy gun body; and a loading device lock which is located on a lateral surface thereof and locked with the gun body first lock when an end portion of the toy gun gas cartridge loading device is housed in the loading device housing of the toy gun body for attachment, and locked with the gun body second lock when detaching the toy gun gas cartridge loading device from the toy gun body.

Also, a toy gun gas cartridge loading device of the present invention houses a gas cartridge, in which a toy gun side end portion in it is housed in a loading device housing of a toy gun body for attachment to the toy gun body, and further comprises:

a loading device coupling valve which is located at a tip of the toy gun gas cartridge loading device and coupled to a gun body coupling valve provided in the toy gun body for attachment to the toy gun body; and a loading device lock which is located on a lateral surface thereof and locked with a gun body first lock when an end portion of the toy gun gas cartridge loading device is housed in the loading device housing of the toy gun body for attachment, and locked with a gun body second lock when detaching the toy gun gas cartridge loading device from the toy gun body.

According to the present invention, the first lock and the second lock interlock with each other, so the following two user actions required for detachment of the device are combined into one user action:

(1) pushing the first lock (2) pushing the second lock

This improves operability and user-friendliness.

Specifically, when attaching a toy gun gas cartridge loading device to the toy gun body by inserting the device through the opening of the loading device housing, a first lock of the gun body is locked with a loading device lock provided on the toy gun gas cartridge loading device.

As the gun body first lock and the loading device lock are unlocked from each other, the toy gun gas cartridge loading device begins moving down by gas pressure.

When detaching the toy gun gas cartridge loading device from the toy gun body, a second lock of the gun body is locked with the loading device lock of the toy gun gas cartridge loading device.

This not only solves the problem that the toy gun gas cartridge loading device may jump out of the toy gun body when detaching the toy gun gas cartridge loading device from the gun for replacement, etc., but also provides a means to improve operability by combining two user actions required for detachment into one.

DETAILED DESCRIPTION OF THE PREFERRED EMBODIMENTS

Figure 1:
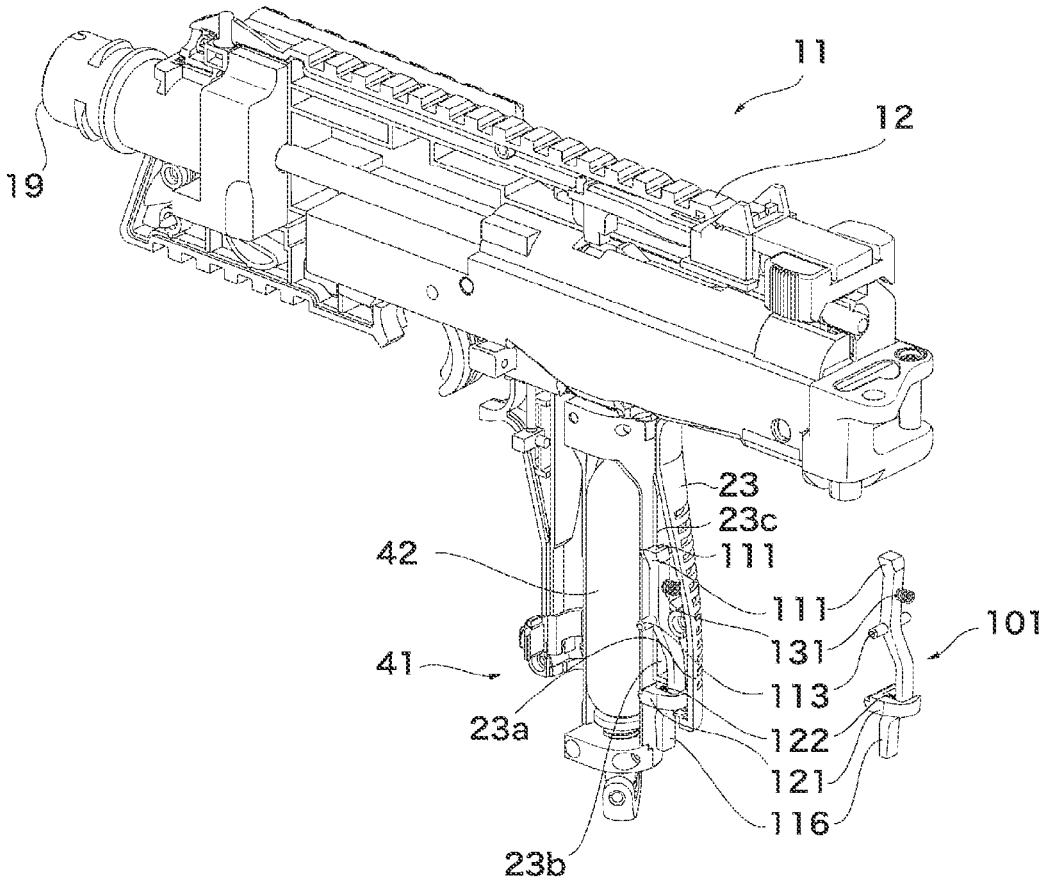
FIG. 1 is a perspective view of a toy gun with a toy gun gas cartridge loading device attached thereto according to an embodiment of the present invention in which a left outer panel is removed.

Next, a preferred embodiment of the present invention will be described referring to FIGS. 1 to 13 which illustrate the embodiment.

A toy gun 11 according to the present invention includes a toy gun body 12 and a toy gun gas cartridge loading device 41 to be attached to the toy gun body 12. The toy gun body 12 includes toy gun body side panels which form both the lateral surfaces of the toy gun body 12.

As shown in FIGS. 2, 7, 9, and 11, inside the toy gun body side panels, the toy gun body 12 has an air chamber 13, a valve 14 located inside the air chamber 13, a tubular bolt 15 located behind the valve 14 which extends in the longitudinal direction of the toy gun 11 and is movable in the longitudinal direction of the gun, and so on.

In the figures, a reference numeral 21 denotes a trigger and a reference numeral 22 denotes a trigger guard. The trigger guard 22 is located around the lower side portion and forward side (muzzle 19 side) portion of the trigger 21 which are not covered by the toy gun body 12 and are exposed to the surroundings.

As the user pulls the trigger 21, the bolt 15 begins moving forward and reciprocates between the pushing position and the retracted position by a bolt spring 15*b* and the pressure of the compressed gas supplied from the valve 14. A reference numeral 15*a* denotes a contact part.

A barrel 17 is located nearer to the muzzle 19 than the valve 14 with a gas discharge part 16 between the valve and the barrel. As the compressed gas supplied from the valve 14 passes in the barrel, a bullet is moved toward the muzzle 19 in the barrel 17 and fired.

A reference numeral 18 denotes a gun body coupling valve. The gun body coupling valve 18 is a nozzle located under the valve 14 and coupled to the valve 14. The gun body coupling valve 18 introduces compressed gas from the toy gun gas cartridge loading device 41 and supplies the compressed gas to the valve 14 in the toy gun body 12.

A reference numeral 23 denotes a loading device housing. The loading device housing 23 has a lower end as an opening around a downward extension of the gun body coupling valve 18 and is in a cylindrical shape. The loading device housing 23 has a double structure which includes an inner wall 23*a* on the inside of which the toy gun gas cartridge loading device 41 is housed, and an outer wall 23*b* which serves as a grip on an outer face. A hollow portion 23*c* is formed by the inner wall 23*a* and the outer wall 23*b*.

A reference numeral 101 denotes a bar-like member. The bar-like member 101 is made of metal.

Figure 3:
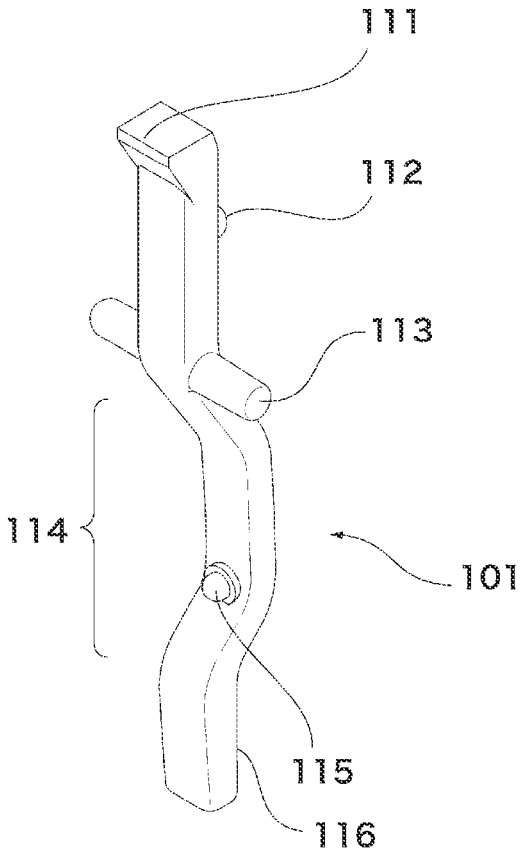
FIG. 3 is a perspective view of a bar-like member according to the embodiment.
Figure 4:
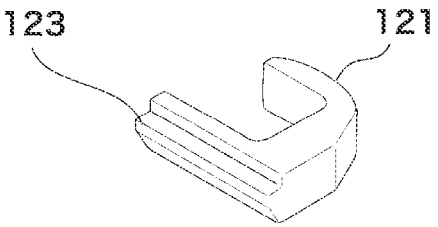
FIG. 4 is a perspective view of a second lock according to the embodiment.

A gun body first lock 111 is located at the top of the bar-like member 101. As shown in FIG. 3, the bar-like member 101 includes the following parts arranged in order downward from the lock 111: a first lock spring mounting boss 112, a bar-like member rotating shaft 113, a curved portion 114, a second lock spring mounting boss 115, and a first lock operating part 116.

The bar-like member 101 is located inside the hollow portion 23*c*.

The bar-like member rotating shaft 113 is slightly nearer to the upper end of the bar-like member 101 than to the center of the bar-like member 101 or in a slightly upper position as seen in the figure. The bar-like member rotating shaft 113 allows the upper and lower ends of the bar-like member 101 to rotate inward of the loading device housing 23 or outward of the loading device housing 23 freely. The bar-like member rotating shaft 113 is fixed on a lateral surface of the loading device housing 23 by itself.

In this embodiment, the bar-like member rotating shaft 113 is located on the bar-like member 101; however, instead the bar-like member rotating shaft 113 may be located in the loading device housing 23 and the bar-like member 101 may have a rotating shaft mounting part for supporting the bar-like member rotating shaft 113.

Figure 5:
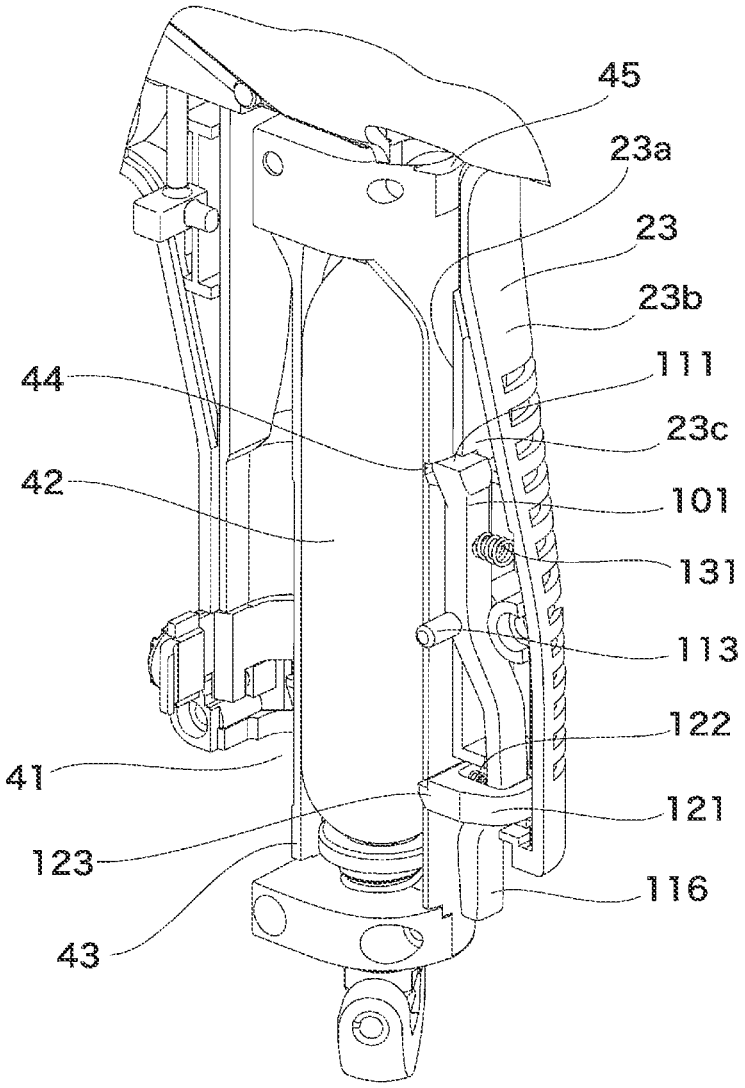
FIG. 5 is a fragmentary enlarged perspective view of the toy gun gas cartridge loading device attached to the toy gun body according to the embodiment in which the left outer panel is removed.

As shown in FIG. 5, a first lock spring 131 is located between the first lock spring mounting boss 112 for the gun body first lock 111 housed in the loading device housing 23 and the inner surface of the outer wall 23*b*. The tip of the gun body first lock 111 is biased inward of the loading device housing 23 by the biasing force of the first lock spring 131.

The bar-like member 101 is located in the hollow portion 23*c* in the loading device housing 23 which corresponds to the grip of the toy gun body 12.

As shown in FIG. 3 and subsequent figures, the gun body first lock 111 is located in an upper portion of the loading device housing 23 and at the upper end of the bar-like member 101. The gun body first lock 111 is locked with a loading device lock 44 provided on the toy gun gas cartridge loading device when attaching the toy gun gas cartridge loading device 41 to the toy gun body 12 by inserting the toy gun body 12 side end portion of the toy gun gas cartridge loading device 41 through the opening of the loading device housing 23.

A reference numeral 121 denotes a gun boy second lock. In this embodiment, the gun body second lock 121 is a U-shaped member; however, instead it may be a circular member. A second lock projection 123 is provided on a gas cartridge 42 side portion of the gun body second lock 121.

The gun body second lock 121 is located so that its U-shaped or circular portion surrounds the lower portion of the bar-like member 101. The gun body second lock 121 is located at least along the lower portion of the bar-like member 101 between the inner wall 23*a* on the gas cartridge 42 side and the inner surface of the outer wall 23*b* of the loading device housing 23.

The second lock projection 123 is located nearer to the lower end of the bar-like member 101 than the bar-like member rotating shaft 113, or more downward in the figures, and more backward than the gun body first lock 111 and locked with the loading device lock 44 located on the lateral surface of the toy gun gas cartridge loading device 41 when detaching the toy gun gas cartridge loading device 41 from the toy gun body 12.

A reference numeral 122 denotes a second lock spring. The second lock spring 122 is located between the gas cartridge 42 side inner surface of the gun body second lock 121 and the second lock spring mounting boss 115 on the gas cartridge 42 side lateral surface of the bar-like member 101. The second lock spring 122 biases the gun body second lock 121 toward the gas cartridge 42.

As shown in the figures, the curved portion 114 of the bar-like member 101 is curved in a way to be away from the gas cartridge 42, namely outward. The curved portion 114 makes it possible to change the size of the gun body second lock 121 and the size of the second lock spring 122 depending on the size of the inside of the loading device housing 23 as the grip of the toy gun body 12 and the size of the toy gun gas cartridge loading device 41 so that the gun body first lock 111 and the gun body second lock 121 work properly.

The first lock operating part 116 is located nearer to the lower end of the bar-like member 114 than the curved portion 114, or more downward in the figures. The toy gun gas cartridge loading device 41 is detached from the toy gun body 12 by pushing the first lock operating part 116 and releasing it.

Next, the toy gun gas cartridge loading device 41 will be described.

In the toy gun gas cartridge loading device 41, a gas cartridge 42 is housed in an outer case 43. When the toy gun gas cartridge loading device 41 is attached to the toy gun body 12, the toy gun side end portion of the device is housed in the loading device housing 23 of the toy gun body 12.

FIG. 1 shows that the toy gun gas cartridge loading device 41 is attached to the toy gun body 12, namely the toy gun gas cartridge loading device 41 is in a static state. In this embodiment, the toy gun gas cartridge loading device 41 houses one gas cartridge 42, but it may house more than one cartridge.

A reference numeral 44 denotes a loading device lock. The loading device lock 44 is in the form of a groove made horizontally in the lateral surface of the toy gun gas cartridge loading device 41.

When the toy gun side end portion of the toy gun gas cartridge loading device 41 is housed in the loading device housing 23 of the toy gun body 12, the device is locked with the gun body first lock. When the toy gun gas cartridge loading device 41 is being detached from the toy gun body 12, the device is locked with the gun body second lock.

As shown in FIG. 5, the toy gun gas cartridge loading device 41 is housed in the toy gun body 12 and fixed. The toy gun gas cartridge loading device 41 is engaged with the toy gun body 12 by the gun body first lock 111 being locked with the toy gun gas cartridge loading device 41. The engagement is made between the loading device lock 44 of the toy gun gas cartridge loading device 41 and the gun body first lock 111 of the toy gun body 12.

A reference numeral 51 denotes a loading device coupling valve. The loading device coupling valve 51 is located at the tip of the toy gun gas cartridge loading device 41 and coupled to the gun body coupling valve 18 of the toy gun body 12 when the device is attached to the toy gun body 12.

A reference numeral 52 denotes a gasket, a reference numeral 53 denotes a cylinder unsealing part, and a reference numeral 54 denotes a gasket. A reference numeral 55 denotes a loading device coupling valve spring which biases the loading device coupling valve 51 to close the valve.

Figure 2:
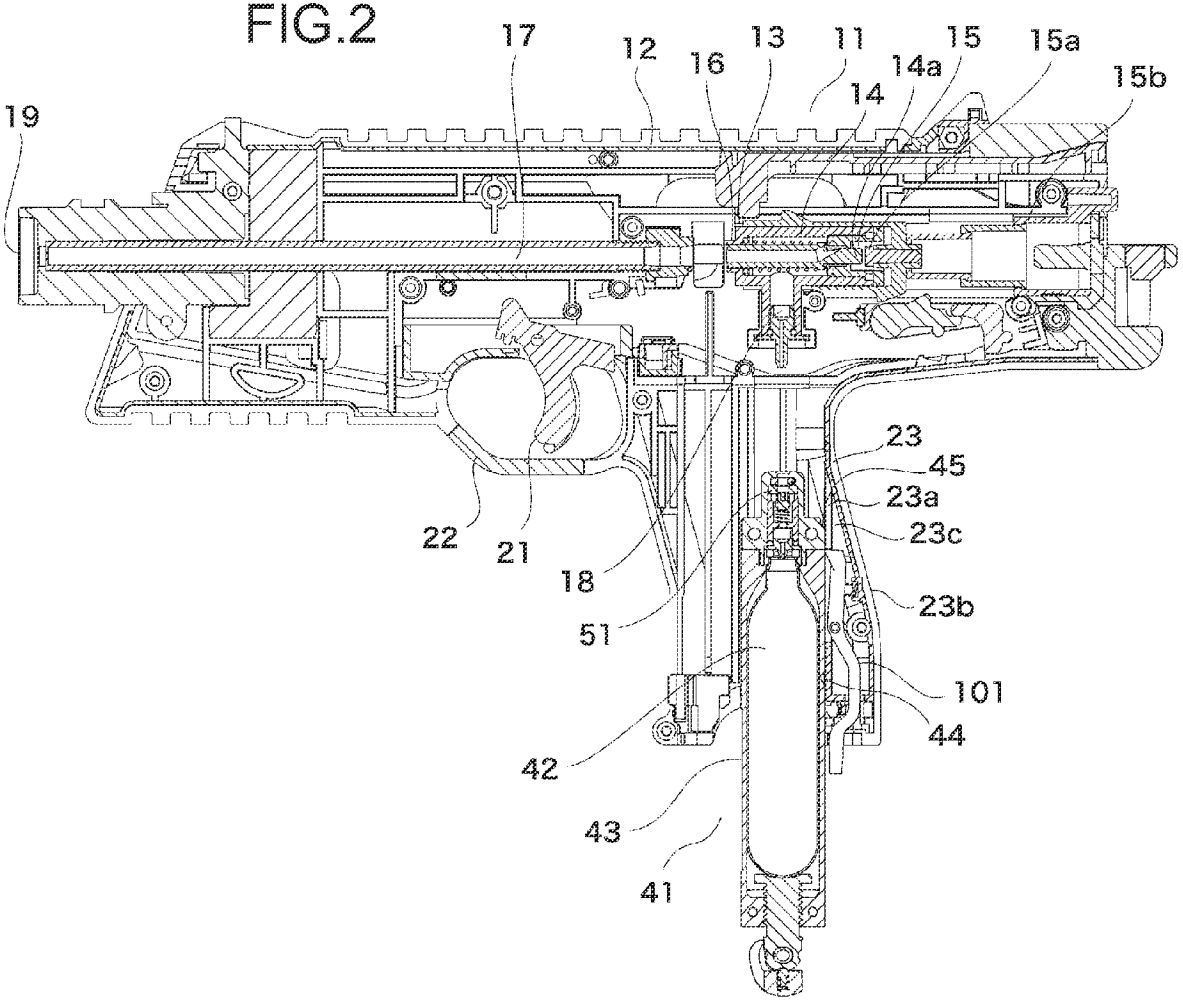
FIG. 2 is a side sectional view of the toy gun gas cartridge loading device attached to the toy gun body according to the embodiment.

In FIG. 2, a reference numeral 15 denotes a bolt. The bolt 15 can move forward and backward freely in the barrel (passage) 17. As the user pulls the trigger 21, the bolt 15 begins moving forward and reciprocates between the pushing position and the retracted position by the bolt spring and compressed gas pressure.

As the bolt 15 moves forward and reaches the pushing position, the rear peripheral part of the air chamber body fits the opening end of the bolt 15. As the bolt 15 further moves forward, the contact part 15*a* pushes forward the sliding projection 14*a* of the valve 14 protruding in the fitting hole. Consequently the valve 14 slides forward and opens the communication between the passage (barrel) 17 and the air chamber 13.

As the communication between the passage 17 and the air chamber 13 is opened, the compressed gas in the air chamber 13 flows into the passage 17 and pushes the back of the bullet held in the bullet holder. As a consequence, the bullet flies out of the muzzle 19. The valve 14 opens or closes the communication between the air chamber 13 and the gas discharge part 16.

When the communication between the passage 17 and the air chamber 13 is opened, the compressed gas pushes the contact part 15*a* backward. Consequently the bolt 15 begins moving backward and reaches the retracted position. The bolt 15, which has reached the retracted position, is pushed by the bolt spring 15*b* and moves forward again. Then, when the bolt reaches the pushing position, it pushes the sliding projection 14*a* of the valve 14 forward. In this way the bolt 15 moves forward and backward repeatedly or makes reciprocating movement. During a single reciprocating movement, the bolt 15 contacts and leaves the valve 14 to open and close the communication between the passage 17 and the air chamber 13.

As the contact part 15*a* leaves the sliding projection 14*a*, the valve spring pushes the valve 14 backward. Consequently the valve 14 slides backward, so the communication between the passage 17 and the air chamber 13 is closed. Then, the air chamber 13 is filled with compressed gas supplied from the gas introduction path.

Next, how the embodiment functions will be described.

Figure 6:
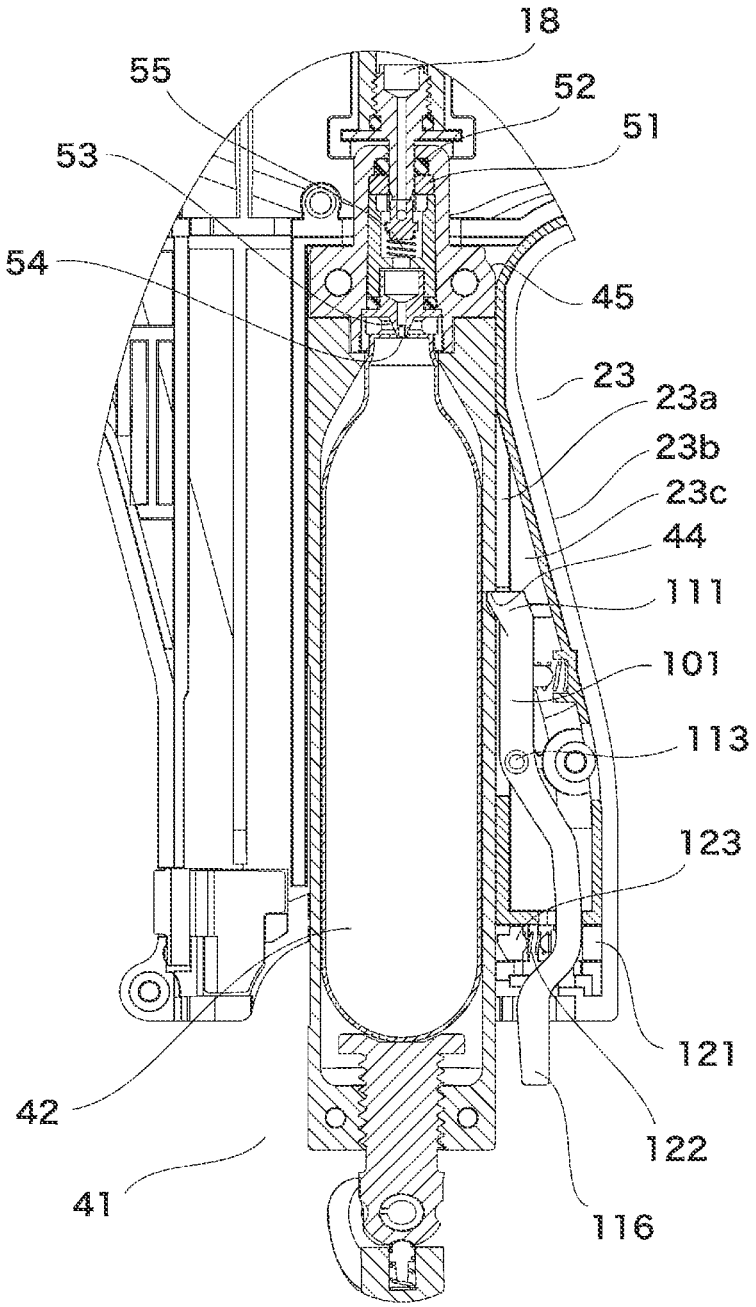
FIG. 6 is a fragmentary enlarged side sectional view of the toy gun gas cartridge loading device attached to the toy gun body according to the embodiment in which a gun body first lock is locked with a loading device lock provided on the toy gun gas cartridge loading device.

As shown in FIG. 6, the bar-like member 101 can rotate around the bar-like member rotating shaft 113. Specifically, the gun body first lock 111 can move toward the gas cartridge 42 or away from the gas cartridge 42, namely outward or toward the outer wall of the loading device housing 23.

The gun body first lock 111 is biased toward the muzzle 19 by the first lock spring 131. Therefore, the gun body first lock 111 of the bar-like member 101 is engaged with the loading device lock 44 of the toy gun gas cartridge loading device 41 so that the toy gun gas cartridge loading device 41 is fixed in the toy gun body 12.

The gun body second lock 121 is located in a way to surround the curved portion 114 of the bar-like member 101 and the second lock spring 122 is located between the gun body second lock 121 and the bar-like member 101.

The adoption of this structure enables the following series of actions.

Figure 7:
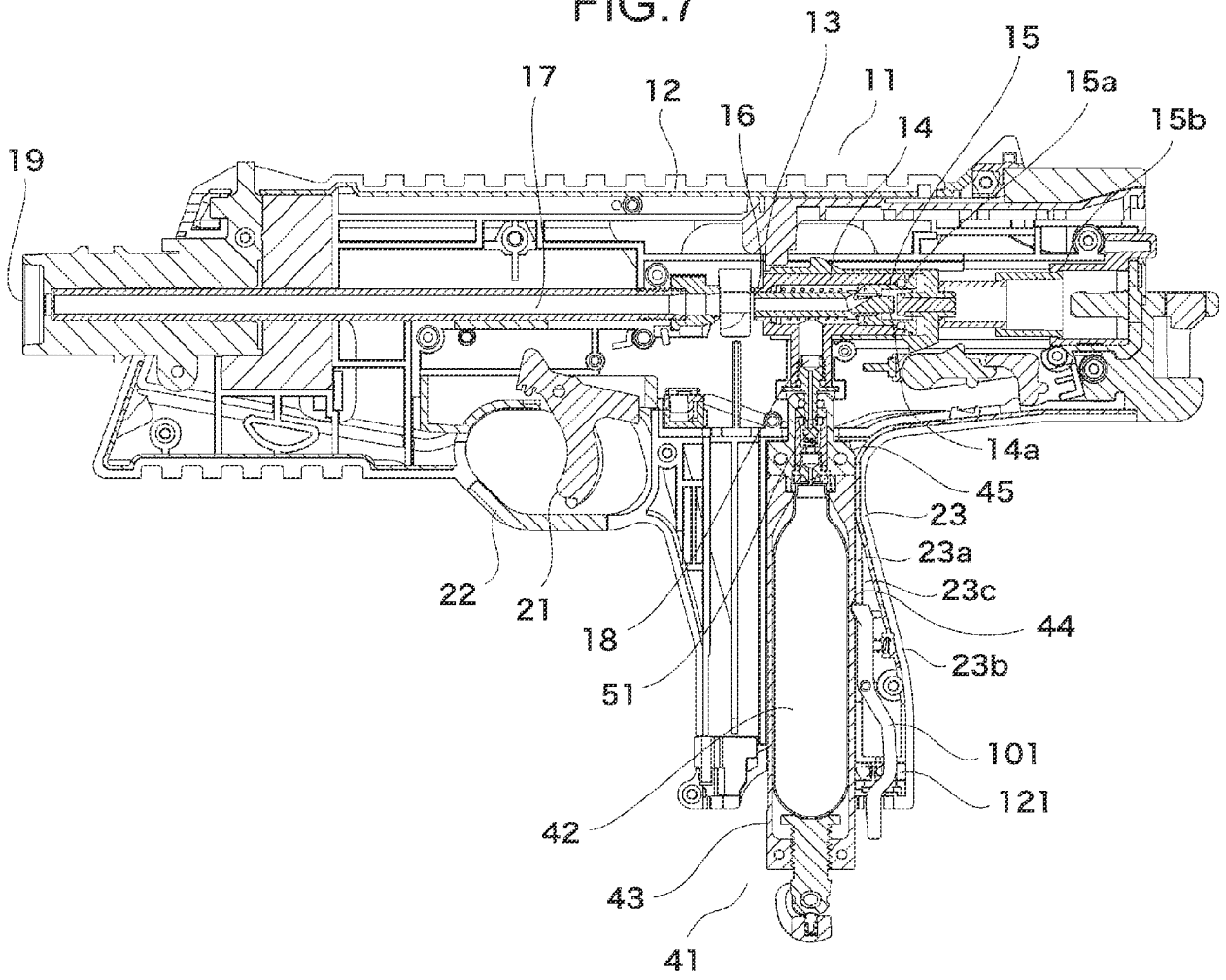
FIG. 7 is a side sectional view of the toy gun gas cartridge loading device attached to the toy gun body according to the embodiment, showing the moment when the gun body first lock is being released from the loading device lock of the toy gun gas cartridge loading device.
Figure 8:
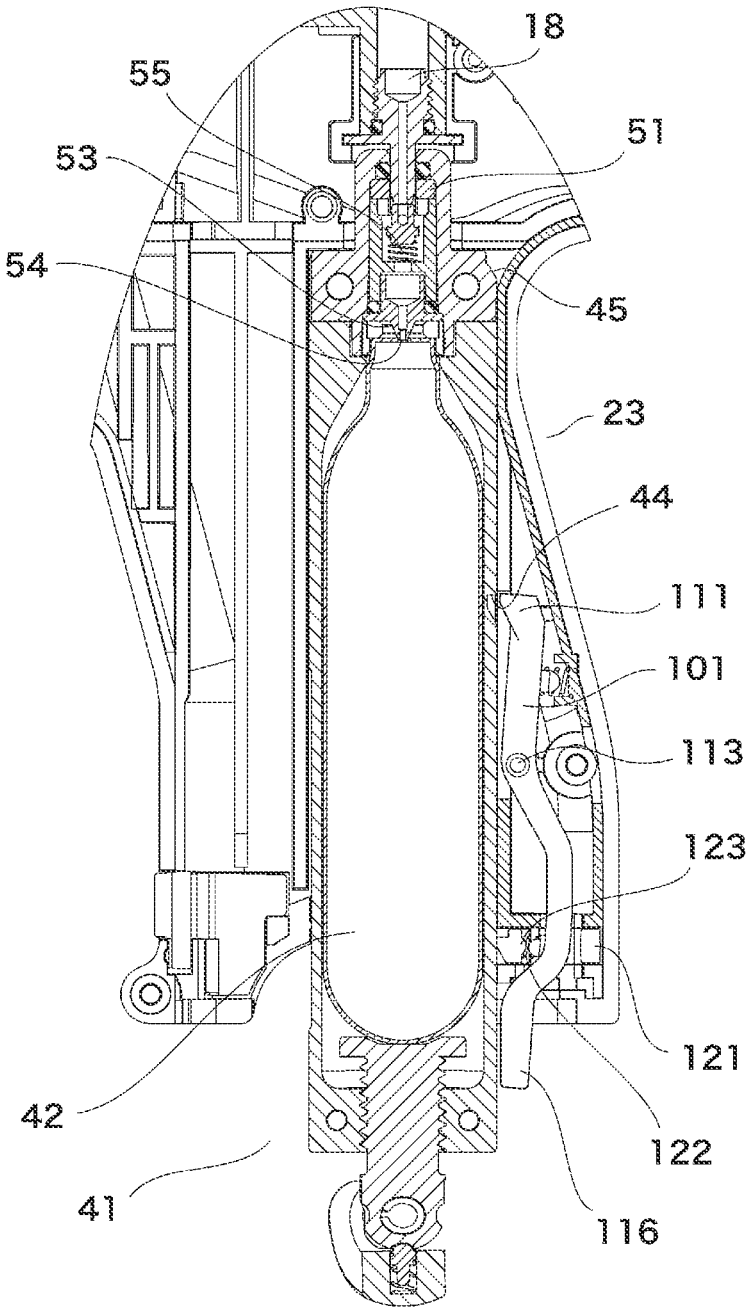
FIG. 8 is a fragmentary enlarged sectional view of what is shown in FIG. 7.

(1) As the first lock operating part 116 is pushed, the gun body second lock 121 tries to move forward through the second lock spring 122, so as shown in FIGS. 7 and 8, while the toy gun gas cartridge loading device 41 is moving down, the second lock projection 123 of the gun body second lock 121 continues to be in contact with the lateral surface of the toy gun gas cartridge loading device 41, then when the loading device lock 44 goes down to the position of the gun body second lock 121, the gun body second lock 121 moves toward the gas cartridge 42 by the biasing force of the second lock spring 122 and the second lock projection 123 of the gun body second lock 121 fits the loading device lock 44.

(2) As the finger is released from the first lock operating part 116, the gun back end side lateral surface of the curved portion 114 pushes the gun back end side inner surface of the gun body second lock 121 and moves it toward the toy gun back end. As a consequence, the second lock projection 123 of the gun body second lock 121 leaves the loading device lock 44.

FIG. 8 is a side sectional view showing the moment when the first lock operating part 116 is pushed with a finger after the state shown in FIG. 6. FIG. 7 is an overall view of the toy gun at the same moment as shown in FIG. 8.

When the first lock operating part 116 is pushed with a finger, the bar-like member 101 slightly rotates clockwise as seen in the figures and the gun body first lock 111 of the bar-like member 101 leaves the loading device lock 44, so that the toy gun gas cartridge loading device 41 and the bar-like member 101 are disengaged from each other.

Consequently the toy gun gas cartridge loading device 41 begins moving down by the pressure of residual gas in the valve 14. At this moment, the gun body second lock 121 tries to move toward the muzzle through the second lock spring 122, but it is blocked by the toy gun gas cartridge loading device 41, so it cannot move.

Figure 9:
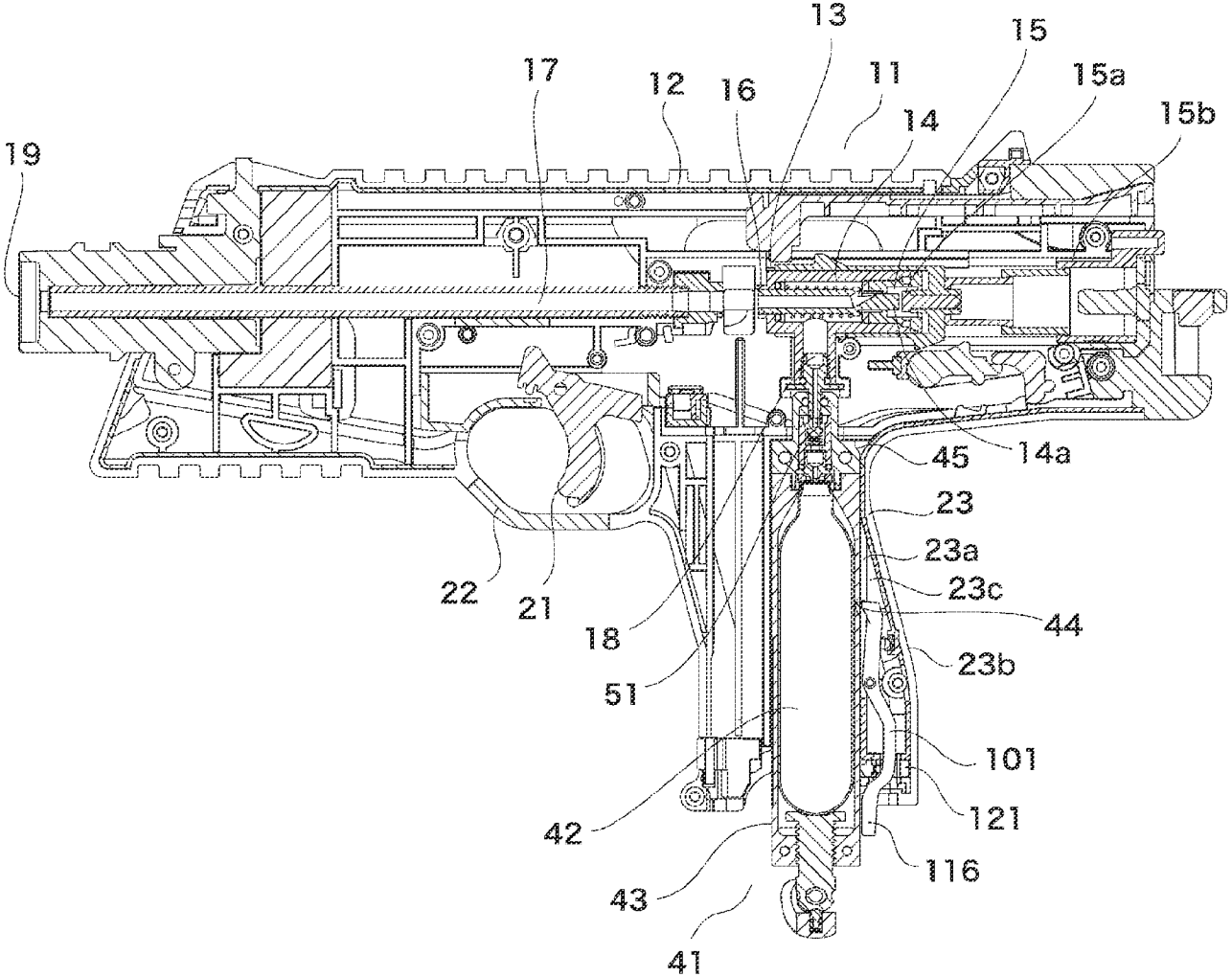
FIG. 9 is a side sectional view of the toy gun gas cartridge loading device attached to the toy gun body according to the embodiment in which the gun body second lock is locked with a loading device lock provided on the toy gun gas cartridge loading device.
Figure 10:
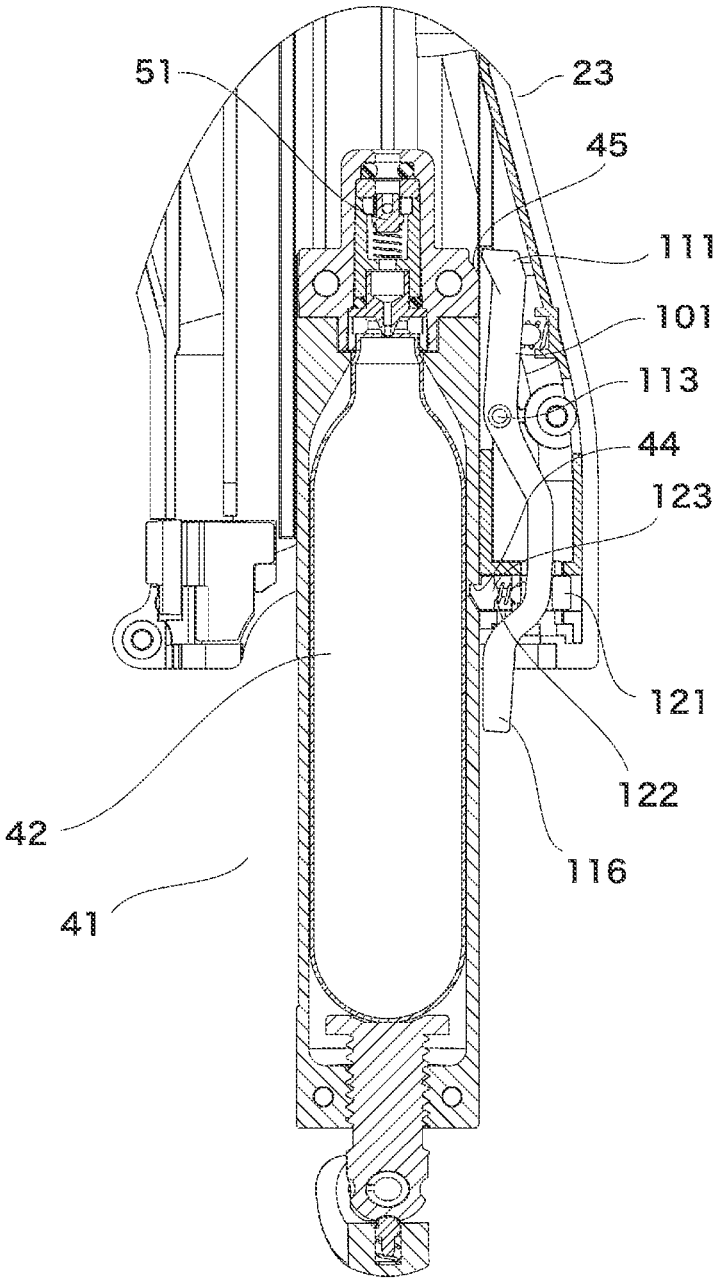
FIG. 10 is a fragmentary enlarged sectional view of what is shown in FIG. 9.

FIG. 10 is a side sectional view showing that the toy gun gas cartridge loading device 41 is engaged with the gun body second lock 121 and locked with the gun body after the state shown in FIG. 8. FIG. 9 is an overall view of the toy gun at the same moment as shown in FIG. 10.

As the toy gun gas cartridge loading device 41 and the bar-like member 101, or the gun body first lock 111 and the loading device lock 44, are disengaged from each other, the toy gun gas cartridge loading device 41 moves down by the pressure of residual gas in the valve 14. While the toy gun gas cartridge loading device 41 is moving down, the second lock projection 123 located on the muzzle 19 side of the gun body second lock 121 continues to be in contact with the toy gun gas cartridge loading device 41.

Then, the loading device lock 44 of the toy gun gas cartridge loading device 41 fits the second lock projection 123 of the gun body second lock 121, so that the toy gun gas cartridge loading device 41 is once locked. At this moment, the finger is held on the first lock operating part 116.

Figure 11:
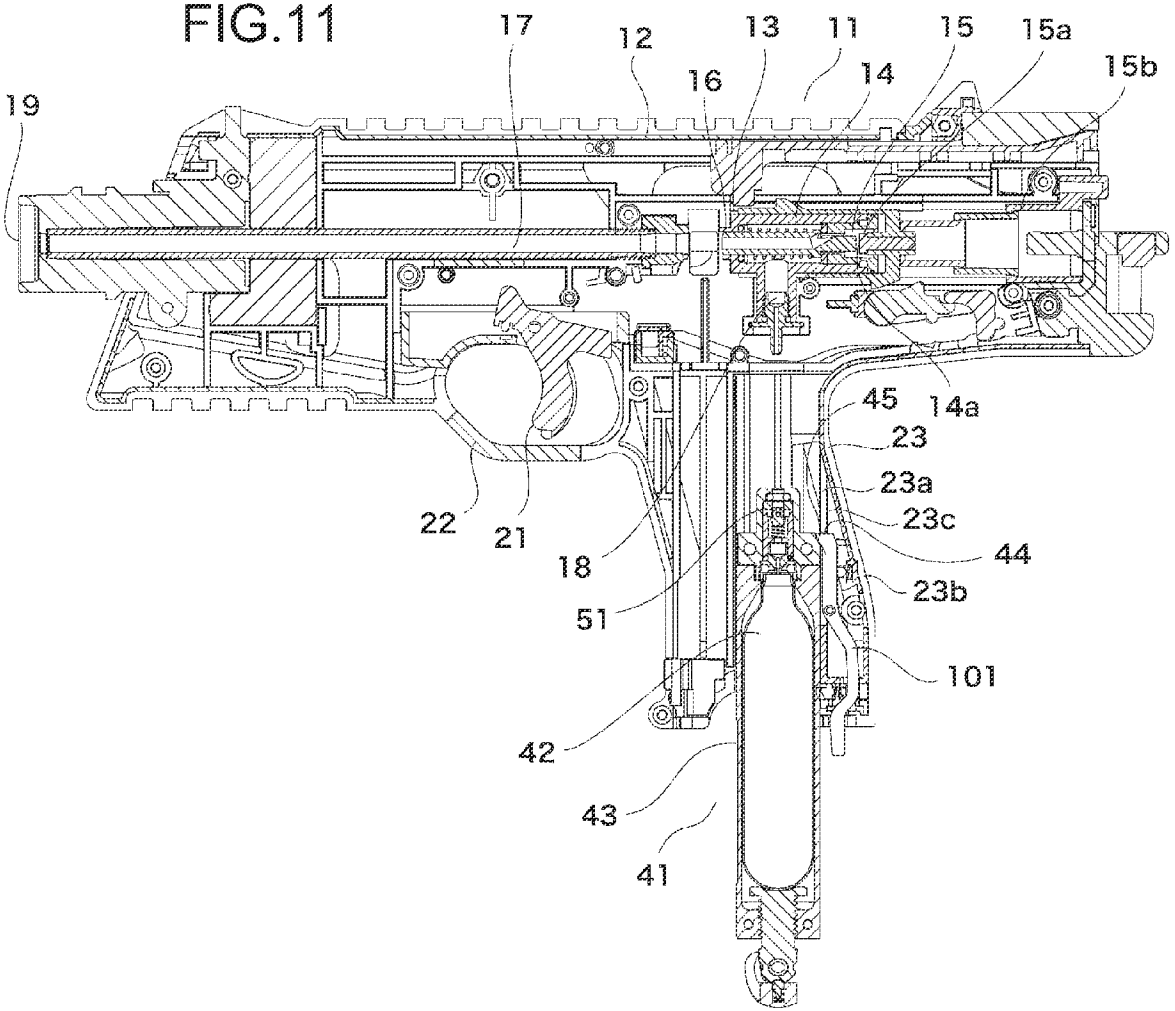
FIG. 11 is a side sectional view of the toy gun gas cartridge loading device attached to the toy gun body according to the embodiment, showing the moment when the gun body second lock is being released from the loading device lock of the toy gun gas cartridge loading device.
Figure 12:
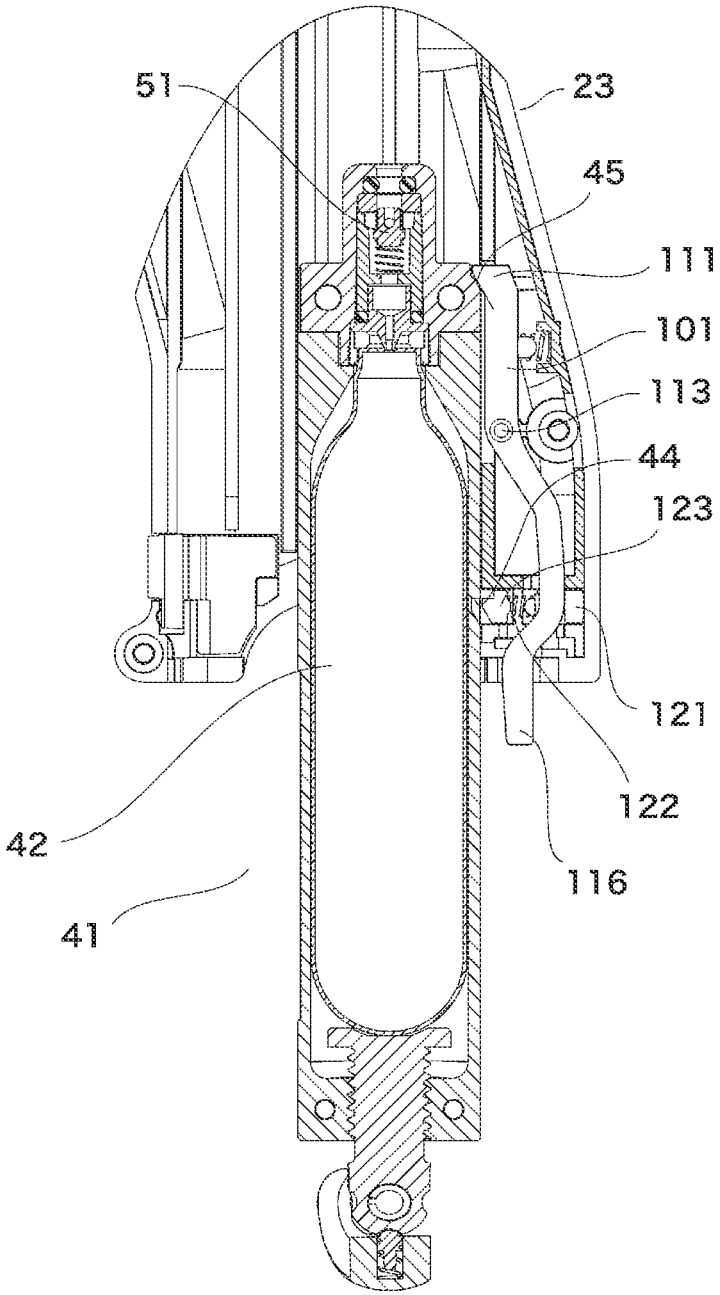
FIG. 12 is a fragmentary enlarged sectional view of what is shown in FIG. 11.

FIG. 12 is a side sectional view showing the moment when the finger is released from the first lock operating part 116 after the state shown in FIG. 10. FIG. 11 is an overall view of the toy gun at the same moment as shown in FIG. 12.

As the finger is released from the first lock operating part 116, the bar-like member 101 is rotated around the bar-like member rotating shaft 113 counterclockwise by the biasing force of the first lock spring 131. Since the bar-like member 101 is in contact with the toy gun back end side inner wall of the gun body second lock 121, the bar-like member 101 pushes the gun body second lock 121 toward the toy gun back end.

As the gun body second lock 121 moves toward the toy gun back end, the second lock projection 123 of the gun body second lock 121 leaves the loading device lock 44. Consequently the toy gun gas cartridge loading device 41 and the gun body second lock 121 are disengaged from each other. In other words, the second lock projection 123 and the loading device lock 44 are disengaged from each other. As a result, the toy gun gas cartridge loading device 41 can be taken out of the toy gun body 12.

Figure 13:
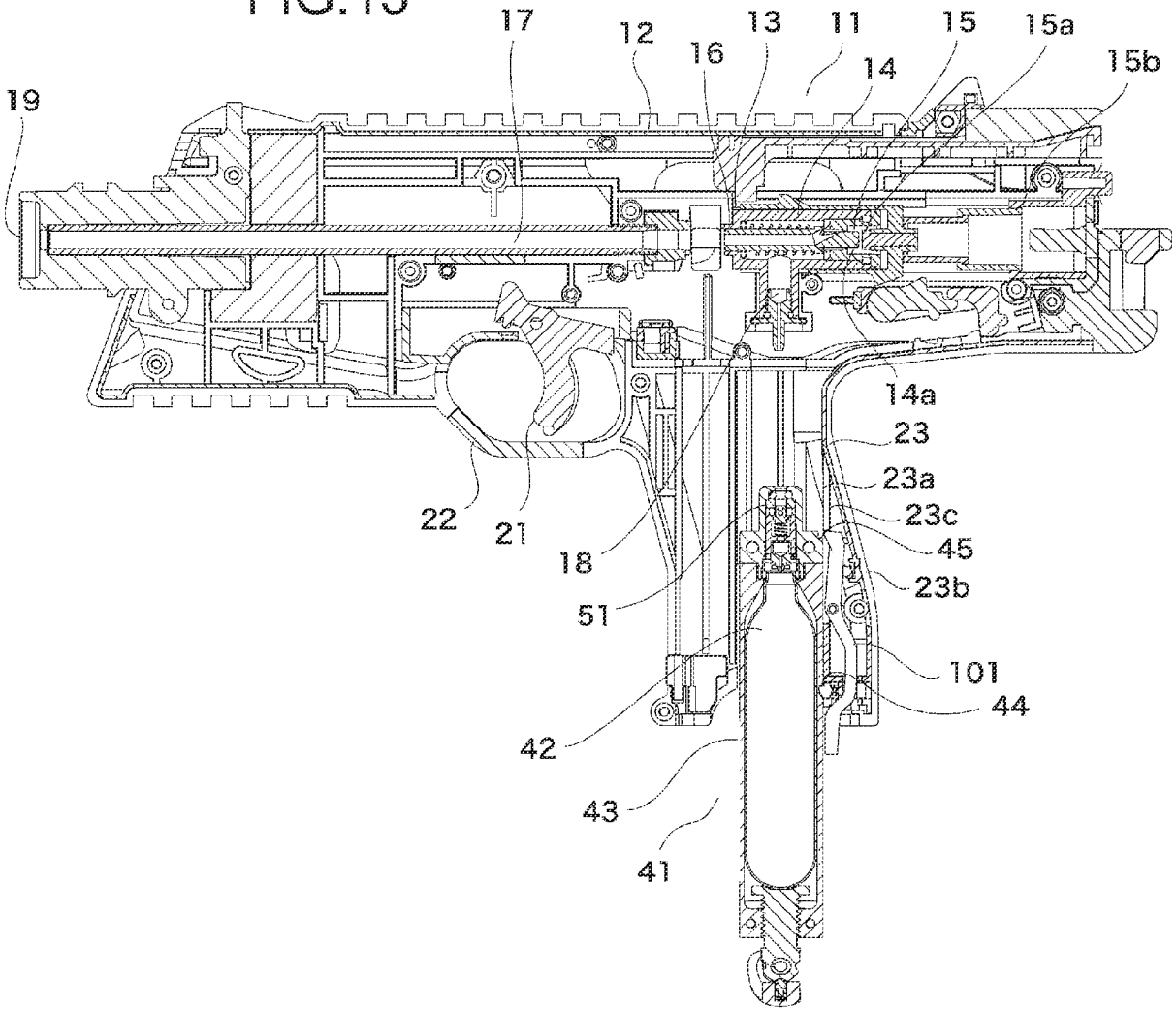
FIG. 13 is a side sectional view showing that the toy gun gas cartridge loading device according to the embodiment is being attached to the toy gun body.
Figure 14:
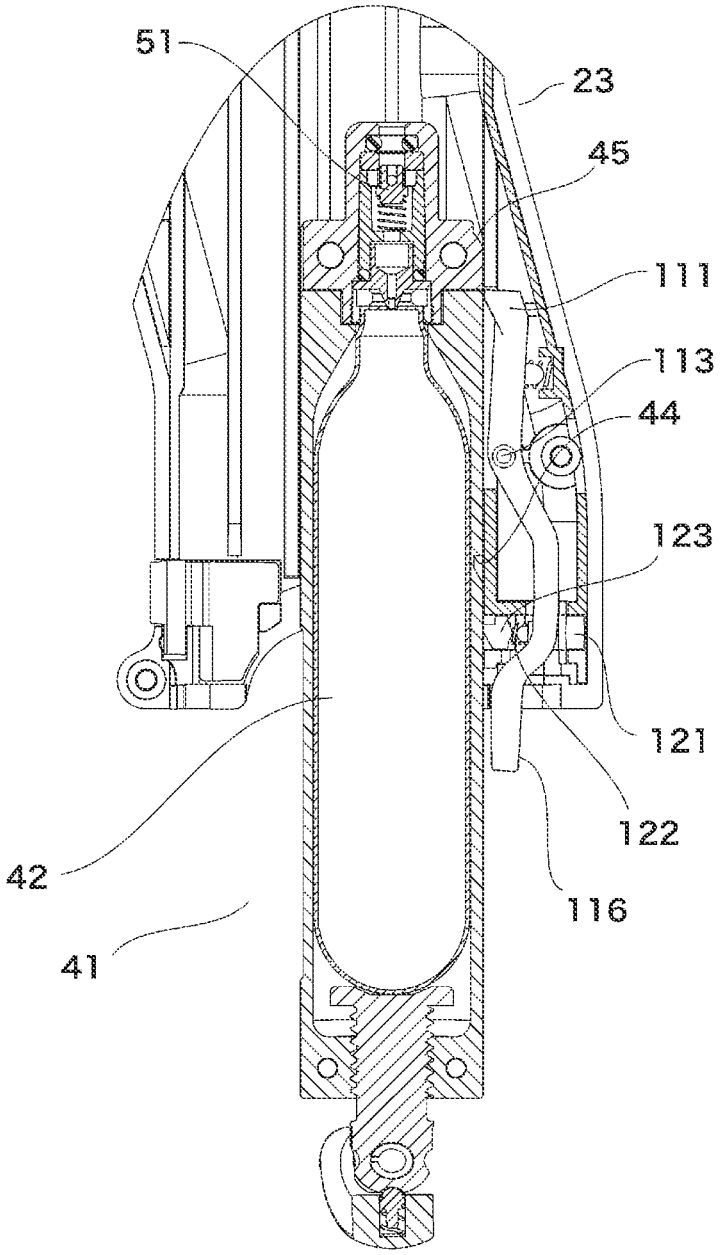
FIG. 14 is a fragmentary enlarged view of what is shown in FIG. 13.
Figure 15:
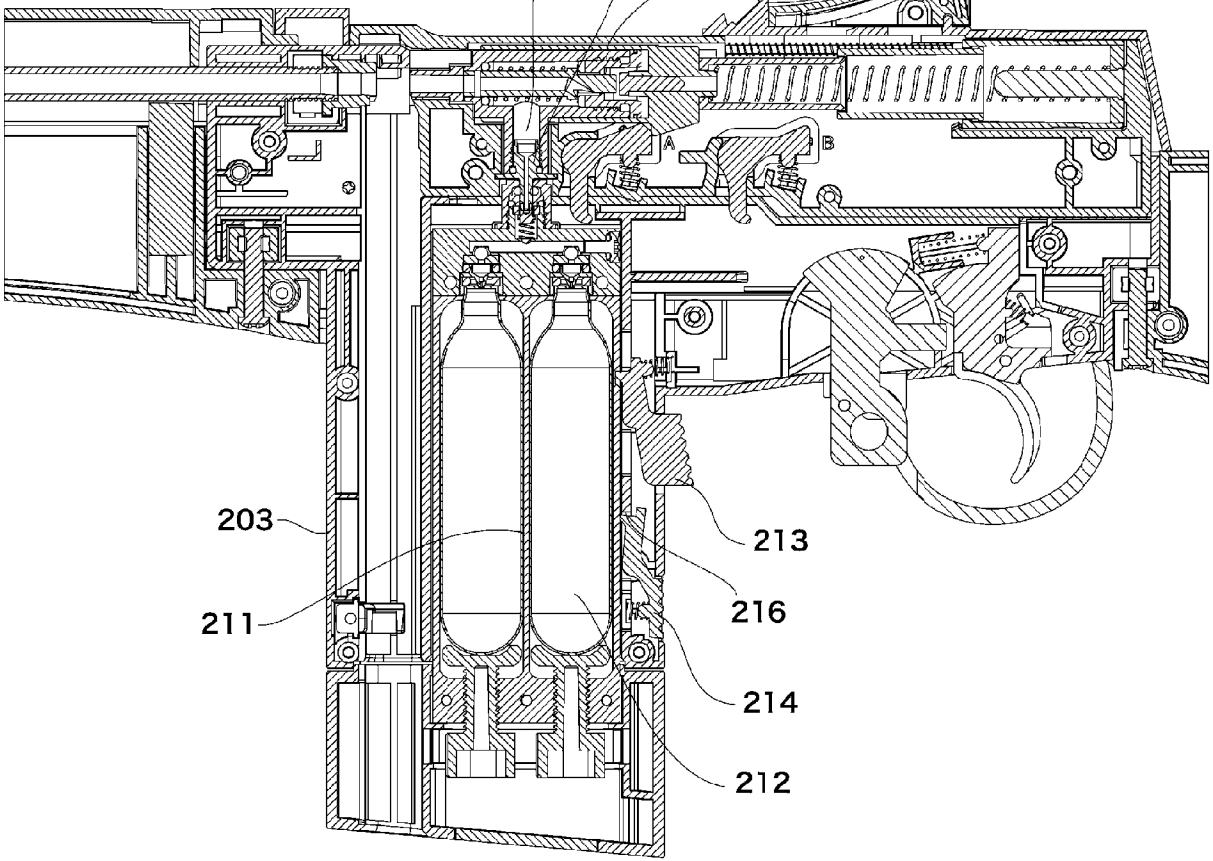
FIG.15 Related Art
FIG. 15 is a side sectional view of a toy gun gas cartridge loading device attached to a toy gun body in the related art in which a gun body first lock is locked with a loading device lock.
Figure 16:
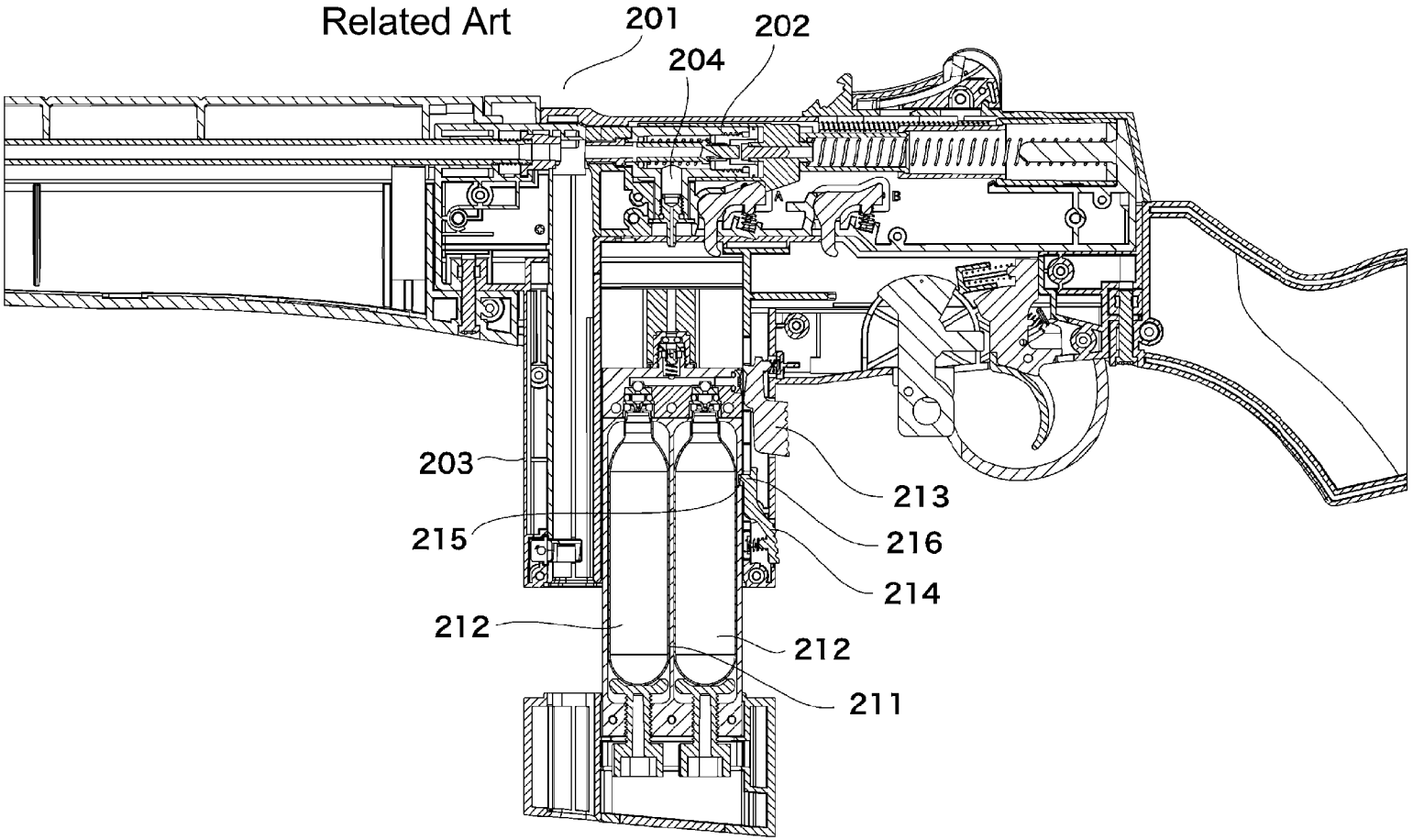
FIG.16 Related Art
FIG. 16 is a side sectional view of the toy gun gas cartridge loading device attached to the toy gun body in the related art in which a gun body second lock is locked with the loading device lock.

FIG. 13 is a side sectional view showing that the toy gun gas cartridge loading device 41 is being attached into the gun body. FIG. 14 is a fragmentary enlarged view of what is shown in FIG. 13.

As the toy gun gas cartridge loading device 41 is inserted through the opening located below the grip as the loading device housing 23 in the toy gun body 12, the bar-like member 101 slightly rotates clockwise and allows the toy gun gas cartridge loading device 41 to be pushed upwards while continuing to be in contact with the toy gun gas cartridge loading device 41. Then, the gun body first lock 111 of the bar-like member 101 fits the loading device lock 44 of the toy gun gas cartridge loading device 41, so that the toy gun gas cartridge loading device 41 is fixed in the toy gun body 12.

In this embodiment, when the first lock operating part 116 is pushed with the finger held on it in order to detach the toy gun gas cartridge loading device 41, the gun body first lock 111 and the loading device lock 44 are released from each other and the toy gun gas cartridge loading device 41 is once released from the toy gun body 12. At the same time, the second lock projection 123 fits the loading device lock 44 and locks the toy gun gas cartridge loading device 41.

As the finger is released from the first lock operating part 116 in this state, the second lock projection 123 and the loading device lock 44 are released from each other, so that the toy gun gas cartridge loading device 41 becomes detachable from the toy gun body 12.

In other words, the gas cartridge loading device is detached step by step by pushing the first lock operating part 116 and then releasing it.

According to the present invention, the bar-like member 101 and the gun body second lock 121 interlock with each other, so the following two user actions required for detachment are combined into one user action:

(1) pushing the bar-like member 101

(2) pushing the gun body second lock 121

This improves operability and user-friendliness.

(1) By pushing down the bar-like member 101, the bar-like member 101 and the toy gun gas cartridge loading device 41 are unlocked from each other and the gas pressure causes the toy gun gas cartridge loading device 41 to begin moving down.

(2) By pushing down the bar-like member 101, the gun body second lock 121 is moved forward and the puncture lock 44 of the toy gun gas cartridge loading device 41, which is moving down, fits the gun body second lock 121 and is locked. At this moment, the bar-like member 101 is still held pushed down.

(3) As the finger is released from the bar-like member 101, the gun body second lock 121 moves backward and the toy gun gas cartridge loading device 41 and the gun body second lock 121 are unlocked from each other and the toy gun gas cartridge loading device 41 becomes safely detachable.

Thus the gas cartridge loading device can be detached step by step only by pushing the bar-like member 101 with a finger and releasing it sequentially.

This means that in an air gun which uses high pressure gas, a gas cartridge can be replaced safely and more easily than before. In addition, the bar-like member 101 is not exposed so much, so there is no significant influence on similarity to a real gun design, which is important for a toy air gun which is manufactured in imitation of a real gun and the commercial value of the toy air gun is not impaired.

The gun according to the present invention may be a fully automatic gun which continues to fire bullets while the trigger is held pulled or it may be any of the following types:

(1) a semiautomatic gun which fires one bullet when the trigger is pulled; and (2) a burst shooting gun which fires several bullets when the trigger is pulled.

How components including the bolt 15 function depend on the type of gun.

In this embodiment of the present invention, the toy gun gas cartridge loading device 41 can be attached and detached as if the magazine of a real gun is attached and detached, so similarity to the real gun is increased.

In this embodiment, as mentioned earlier, the gun body second lock 121 having the second lock projection 123 is located so that its U-shaped or circular portion surrounds the lower portion of the bar-like member 101.

If the second lock projection 123 is directly located on the lower portion of the bar-like member 101 and integrated with it, an attempt to push the first lock operating part 116 may fail or the first lock operating part 116 cannot be pushed since the tip of the second lock projection 123 interferes with the toy gun gas cartridge loading device 41.

If the length of the second lock projection 123 is decreased in order to prevent the tip of the second lock projection 123 from interfering with the toy gun gas cartridge loading device 41, both the gun body first lock 111 and the second lock projection 123 may fail to lock the toy gun gas cartridge loading device 41 even when the first lock operating part 116 is pushed. Also, it may become necessary to push the second lock projection 123.

If, in order to prevent the tip of the second lock projection 123 from interfering with the toy gun gas cartridge loading device 41, a notch is made in the lateral surface of the toy gun gas cartridge loading device 41 instead of decreasing the length of the second lock projection 123, it may happen that the gun body first lock 111 interferes with the lateral surface of the toy gun gas cartridge loading device 41 and the second lock projection 123 cannot be unlocked.

In this case there is a problem that the lateral surface of the toy gun gas cartridge loading device 41 must be shaved in order to prevent interference with the lateral surface of the toy gun gas cartridge loading device 41.

If the gun body second lock 121 does not have a U-shaped or circular portion and is not located in a way to surround the lower portion of the bar-like member 101, it may happen that after the gun body second lock 121 and the loading device lock 44 fit each other, they cannot be released from each other.

Specifically, when the user holds the toy gun body 12 in a normal manner, a force to sandwich the gun body second lock 121 is applied to the gun body second lock 121 by the loading device lock 44 of the toy gun gas cartridge loading device 41 and the outer wall of the outer panel below the gun body second lock 121. In order to disengage the gun body second lock 121 and the loading device lock 44 of the toy gun gas cartridge loading device 41 from each other, the gun body second lock 121 must move toward the back end of the toy gun body 12 against the force to sandwich.

The force of connection between the gun body second lock 121 and the second lock spring 122 and the force of connection between the bar-like member 101 and the second lock spring 122 must be strong enough to counter the force to sandwich. If the force of connection between the gun body second lock 121 and the second lock spring 122 fails to counter the force to sandwich, the gun body second lock 121 and the second lock spring 122 will be disconnected.

If the strength of the second lock spring 122 itself is not sufficient, the second lock spring 122 may become loose over time of use, resulting in an unlocking failure.

What is claimed is:

1. A toy gun comprising a toy gun body and a toy gun gas cartridge loading device to be attached to the toy gun body, the toy gun body comprising:

a gun body coupling valve for introducing compressed gas from outside and supplying the compressed gas into the toy gun body;

a loading device housing located around the gun body coupling valve;

a bar-like member which is attached midway to a lateral surface of the loading device housing by a bar-like member rotating shaft for allowing an upper end and a lower end thereof to freely rotate inward of the loading device housing or outward of the loading device housing, with the upper end biased inward of the loading device housing;

a gun body first lock which is located in an upper portion of the loading device housing and provided on the upper end of the bar-like member and locked with a loading device lock provided on the toy gun gas cartridge loading device when inserting a toy gun body side end portion of the toy gun gas cartridge loading device through an opening of the loading device housing for attachment to the toy gun body; and a gun body second lock which is located nearer to the lower end of the bar-like member than the bar-like member rotating shaft and lower than the gun body first lock and locked with the loading device lock provided on the toy gun gas cartridge loading device when detaching the toy gun gas cartridge loading device from the toy gun body, being U-shaped or circular, wherein the toy gun gas cartridge loading device houses a gas cartridge; and for attachment to the toy gun body, a toy gun side end portion of the toy gun gas cartridge loading device is housed in the loading device housing of the toy gun body;

the toy gun gas cartridge loading device comprising:

a loading device coupling valve which is located at a tip of the toy gun gas cartridge loading device and coupled to a gun body coupling valve of the toy gun body for attachment to the toy gun body; and a loading device lock which is located on a lateral surface thereof and locked with the gun body first lock when an end portion of the toy gun gas cartridge loading device is housed in the loading device housing of the toy gun body for attachment, and locked with the gun body second lock when detaching the toy gun gas cartridge loading device from the toy gun body; and wherein the gun body second lock at least partially surrounds the bar-like member.

2. A toy gun cartridge loading device to be attached to a toy gun body, the toy gun body comprising:

a gun body coupling valve for introducing compressed gas from outside and supplying the compressed gas into the toy gun body;

a loading device housing located around the gun body coupling valve;

a bar-like member which is attached midway to a lateral surface of the loading device housing by a bar-like member rotating shaft for allowing an upper end and a lower end thereof to freely rotate inward of the loading device housing or outward of the loading device housing, with the upper end biased inward of the loading device housing;

a gun body first lock which is located in an upper portion of the loading device housing and provided on the upper end of the bar-like member and locked with a loading device when inserting a toy gun body side end portion of the toy gun gas cartridge lading device through an opening of the loading device housing for attachment to the toy gun body; and a gun body second lock which is located nearer to the lower end of the bar-like member rotating shaft and lower than the gun body first lock and locked with the loading device lock provided on the toy gun gas cartridge loading device when detaching the toy gun gas cartridge loading device from the toy gun body, being U-shaped or circular, and the toy gun gas cartridge loading device which houses a gas cartridge and in which a toy gun side end portion is housed in a loading device housing of a toy gun body for attachment to the toy gun body, the toy gun gas cartridge loading device comprising:

a loading device coupling valve which is located at a tip of the toy gun gas cartridge loading device and coupled to a gun body coupling valve provided in the toy gun body for attachment to the toy gun body; and a loading device lock which is located on a lateral surface thereof and locked with a gun body first lock when an end portion of the toy gun gas cartridge loading device is housed in the loading device housing of the toy gun body for attachment, and locked with a gun body second lock when detaching the toy gun gas cartridge loading device from the toy gun body; and wherein the gun body second lock at least partially surrounds the bar-like member.

3. The toy gun according to claim 1, wherein the gun body second lock surrounds the bar-like member.

* * * * *